US005412167A

United States Patent [19]

Mueller et al.

[11] Patent Number: 5,412,167

[45] Date of Patent: May 2, 1995

[54] LOCKING DEVICE FOR AN ELECTRICAL SWITCH

[75] Inventors: Robert W. Mueller, North Fayette Township, Allegheny County; Glen C. Sisson, Center Township, Beaver County; James G. Maloney, Industry; David A. Parks, Economy; Arthur D. Carothers, Beaver Falls; William E. Beatty, Jr., Brighton Township, Beaver County, all of Pa.

[73] Assignee: Eaton Corporation, Cleveland, Ohio

[21] Appl. No.: 133,430

[22] Filed: Oct. 8, 1993

[51] Int. Cl.[6] ..... H01H 9/28

[52] U.S. Cl. ..... 200/43.14; 200/43.15; 200/43.19

[58] Field of Search ..... 200/43.11, 43.14, 43.15, 200/43.16, 43.19, 43.21

[56] References Cited

U.S. PATENT DOCUMENTS

| | | | |
|---|---|---|---|
| 1,550,031 | 8/1925 | Kovar et al. | 200/43.11 X |
| 2,983,799 | 5/1961 | Osieja et al. | 200/43.15 |
| 3,109,899 | 11/1963 | Pastene | 200/43.19 |
| 3,214,530 | 10/1965 | Tharp et al. | 200/43.15 |
| 3,291,924 | 12/1966 | Tharp | 200/43.15 |
| 3,629,529 | 12/1971 | Dietz | 200/43.19 |
| 4,260,861 | 4/1981 | DiMarco | 200/43.15 |
| 4,677,261 | 6/1987 | Nourry | 200/43.15 |
| 5,207,315 | 5/1993 | Benda | 200/43.11 |

*Primary Examiner*—Renee S. Luebke

*Attorney, Agent, or Firm*—Martin J. Moran

[57] ABSTRACT

A locking device is insertable into a cover opening adjacent to a handle of an electrical switch to occupy the space in the cover opening for resisting movement of the handle. The locking device has two pivotally connected members. The pivotal movement of the members creates a collapsed condition or an expanded condition for the locking device. The pivotal members have a transverse opening which are alignable relative to each other when the locking device is in its expanded condition. The locking device is inserted into the cover opening when the pivotal members are collapsed. In a first embodiment, a handle shroud member has an opening for receiving the handle and a second member has leg means along its base for engaging an undersurface around the cover opening when the locking device is in its expanded condition. In a second and a third embodiment, both pivotal members have leg means for engaging undersurfaces around the cover opening when the locking device is in its expanded condition. Once the apertures of the members are in alignment, a padlock is inserted therethrough for retaining the locking device in its expanded condition in the cover opening thereby resisting movement of the handle of the electrical switch.

4 Claims, 5 Drawing Sheets

LOCKING DEVICE FOR AN ELECTRICAL SWITCH

BACKGROUND OF THE INVENTION

1. Field of the Invention

This invention relates to a handle block lock-off device for resisting movement of a slidable handle of an electrical switch once the handle is positioned in an operative or in an inoperative mode for the electrical switch.

2. Description of the Prior Art

Generally, an electrical switch for use with various apparatuses such as a circuit breaker, electrical contactors, or motor controllers, has an extended handle slidable in an "on" or an "off" position for the electrical switch.

For safety purposes, once the handle is slid into its desired positioning, it would be ideal to be able to lock it in place so as to prevent it from being moved.

To date, such a locking device for resisting movement of a handle of an electrical switch is unknown. There remains, therefore, a very real and substantial need for a locking device for resisting movement of a handle of an electrical device once it is slid into a desirable "on" or "off" positioning.

SUMMARY OF THE INVENTION

The present invention has met the above described needs. The present invention pertains to a locking device which is insertable into an opening of a cover of an electrical switch and which locks and is secured in place to resist movement of a handle of the electrical switch.

In one embodiment of the present invention, the locking device comprises two molded members connected together by a pivotal pin. One member is a handle shroud member and has a handle receiving opening and a transverse aperture, and the other member pivots on the handle shroud member and has a transverse aperture and leg means along its base. For installation, the members are in their collapsed form where the transverse apertures of the two members are in non-alignment and the leg means of the other pivotal member are extended in its most outward positioning away from the handle shroud member. The two members in their collapsed form are inserted into the opening of a cover of an electrical switch with the handle being received in the opening of the handle shroud member. The other pivotal member is then pivoted on the handle shroud member to bring the transverse apertures into alignment and to expand the locking device so that it fits snugly into the opening of the cover and the leg means of the pivotal member are wedged underneath the cover to contact an undersurface parallel to the length of the handle. Preferably, a padlock is inserted into the aligned transverse apertures to retain the two pivotal members in their expanded condition, thereby securing the locking device in the cover opening.

A second embodiment for the locking device of the present invention comprises an outer and an inner pivotal member, each having a transverse aperture and leg means along their base. This locking device in its collapsed condition where the transverse apertures are non-aligned is insertable into the opening adjacent to the handle of the electrical switch similar to that of the first embodiment. Once inserted into the cover opening, the two members are pivoted so that the transverse apertures are aligned and the leg means of both pivotal members are wedged underneath the cover to contact parallel sides of the opening perpendicular to the length of the handle. Here again, preferably, a padlock is inserted through the aligned transverse apertures to retain the locking device in the cover opening.

A third embodiment is similar to that of the second embodiment but entails a different design for the inner and outer pivotal members. The outer member is comprised of two pieces interconnected by pin means and receiving means. The inner member has an integral lug for its pivotal movement relative to the two outer connected members. A retainer can be used to hold the locking; device when it is not in use, and a retaining cable prevents the locking device from being misplaced or taken.

It is, therefore, an object of the present invention to provide a means for retaining a handle of an electrical switch of an apparatus in a desired positioning.

It is a further object of the present invention to provide a locking device for resisting movement of a handle block of an electrical switch once the handle is slid into a desired "on" or "off" positioning.

It is a further object of the present invention to provide a locking device which is insertable into the cover opening through which a handle extends to fill the empty space not occupied by the handle to inhibit or resist undesirable movement of the handle within the cover opening.

These and other objects of the present invention will be more fully understood and appreciated from the following description of the invention in reference to the illustrations appended hereto.

DETAILED DESCRIPTION OF THE PREFERRED EMBODIMENTS

Figure 1:
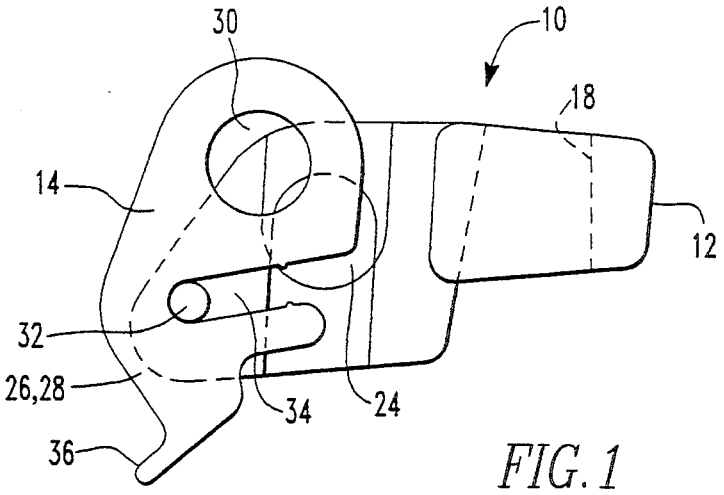
FIG. 1 is a front elevational view of a first embodiment of a locking device of the present invention in a collapsed form prior to its insertion into a cover opening of an electrical device.
Figure 2:
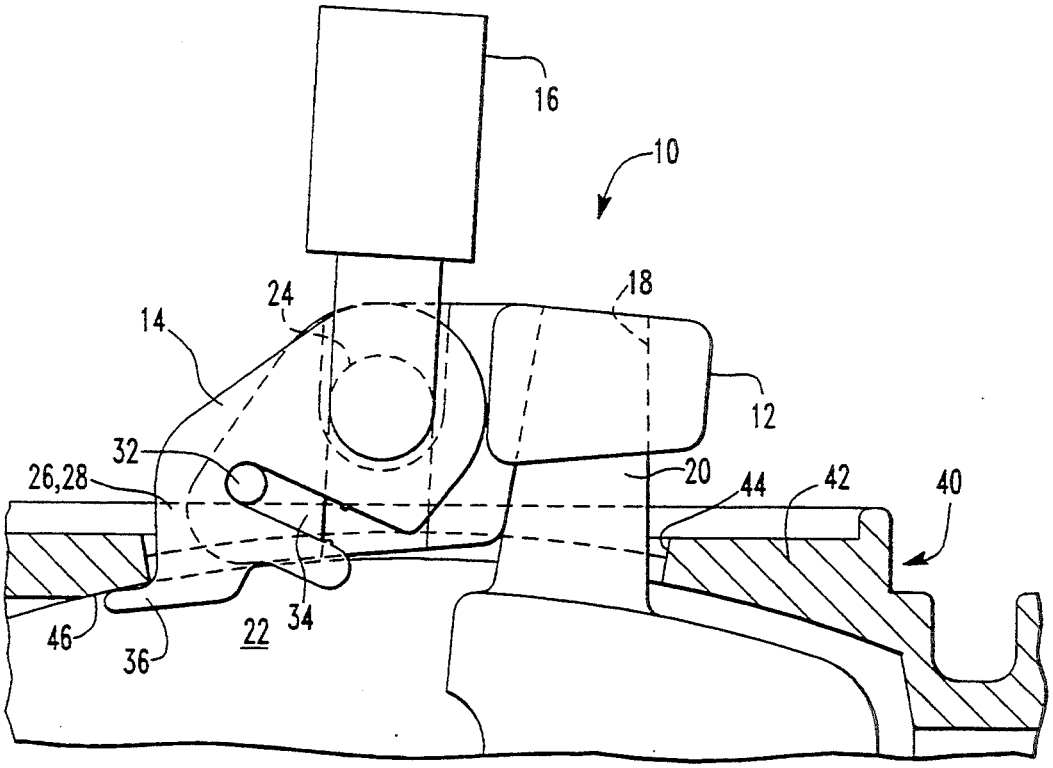
FIG. 2 is a front elevational view showing the embodiment of FIG. 1 in an expanded condition after its insertion into the cover opening with a padlock.
Figure 3:
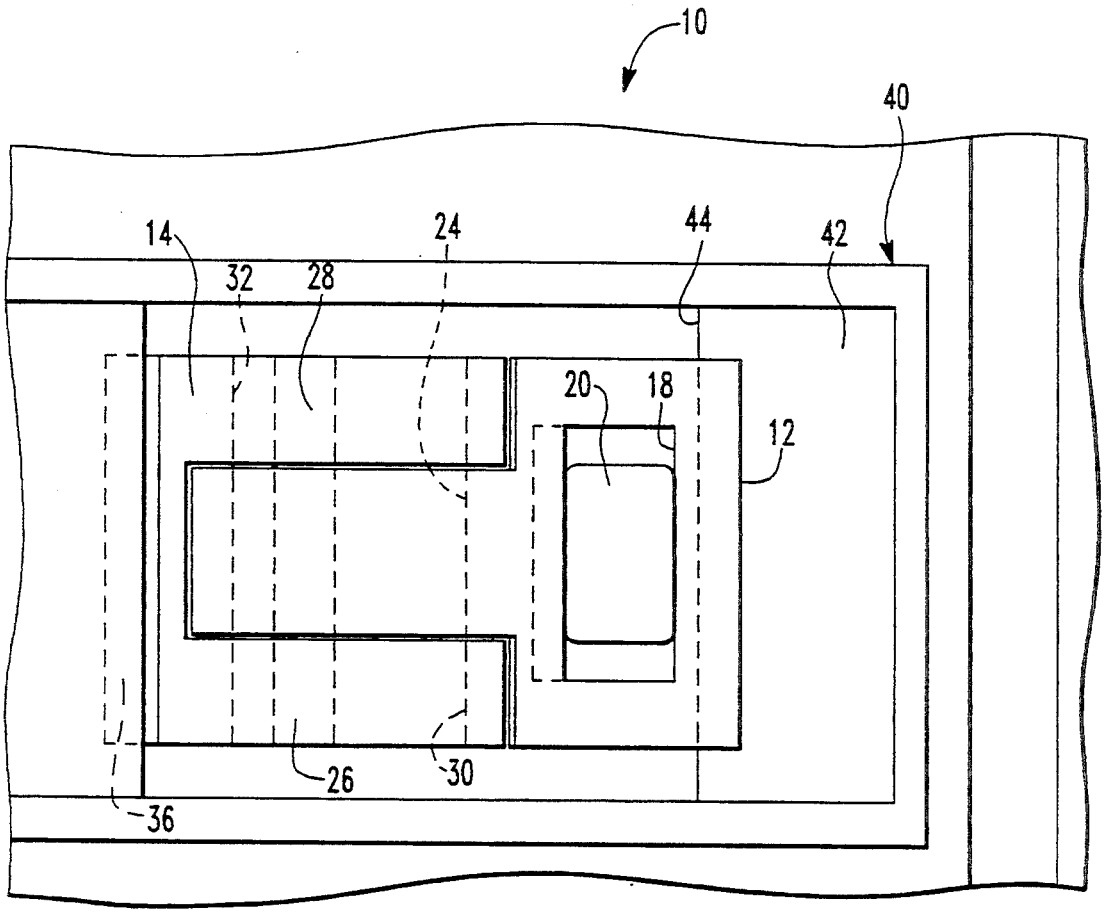
FIG. 3 is a top plan view of the embodiment of FIG. 1 without the padlock.

Referring first to FIGS. 1, 2, and 3, the locking device 10 for a first embodiment of the present invention is comprised essentially of pivotal members 12 and 14, and a padlock 16.

As shown particularly in FIGS. 1 and 2, member 12, hereinafter referred to as a handle shroud member, has a rectangular end portion with an opening 18 which extends from the top of and down through the one end of the handle shroud member for receiving a handle 20 (FIG. 2) of an electrical switch 22, and an extended portion with a transverse aperture 24 which fits into member 14. Member 14 is a U-shaped member with spaced-apart parallel sidewalls 26 and 28. Each sidewall 26 and 28 has a centrally located transverse aperture, one of which is indicated at number 30 in FIG. 3 which are aligned relative to each other. As can best be seen in FIG. 3, member 14 is pivotally connected to the extended portion of pivotal member 12 by pivotal pin 32 for pivotal movement of member 14 relative to member 12. Pivotal pin 32 extends through sidewalls 26 and 28 and member 12, and member 14 is mounted on pivotal pin 32, by way of a slot in sidewalls 26 and 28, one of which is indicated at 34 in sidewall 26 in FIGS. 1 and 2.

Member 14 has a leg or foot 36 which extends along the length of its base.

Preferably, both handle shroud member 12 and pivotal member 14 are molded plastic.

FIG. 2 shows the locking device 10 of FIG. 1 installed over handle 20 of electrical switch 22 of a circuit breaker 40. The circuit breaker 40 has a molded front cover 42 with an opening 44 through which handle 20 extends. Opening 44 is wide enough to allow handle 20 to be slidably moved to an "on" or "off" position and for receiving locking device 10.

In referring to FIG. 2, for installation of locking device 10 into circuit breaker 40, pivotal member 14 is in the collapsed position of FIG. 1, where the transverse apertures of pivotal member 14 are in non-alignment with aperture 24 of member 12, and where the leg or lip 36 of the base of member 14 is positioned remotely from handle shroud member 12. Opening 18 of handle shroud member 12 has tapered sidewalls which correspond to the tapered sidewalls of handle 20. Opening 18 is positioned in line with handle 20 of the electrical switch 38 of circuit breaker 40, and disposed thereover so that handle 20 is received in opening 18 and the tapered sides of handle shroud member 12 come in contact with those of handle 20 when member 12 is slid over handle 20. At the same time, pivotal member 14 is received in opening 44 where it is caused to pivot when leg or lip 36 of pivotal member 14 is slid underneath cover 42 of circuit breaker 40 for engagement with an undersurface 46 of cover 42. This dual action of handle 20 being received in opening 18 of handle shroud member 12 and leg means 36 engaging undersurface 46 of cover 42 causes pivotal member 14 to pivot on pivotal pin 32 and the transverse apertures of pivotal member 14 to become aligned with transverse aperture 24 of handle shroud member 14. For retainment of locking device 10 in opening 44 and on handle 20 of circuit breaker 40, padlock 16 is placed through the aligned apertures of members 12 and 14 in a manner shown in FIG. 2, so that locking device 10 cannot become collapsed and therefore removed from breaker handle 20.

The locking device 10 when disposed in a manner as shown in FIG. 2, resists movement of handle 20, which handle 20 may be in either an "on" or "off" position for circuit breaker 40.

Figure 4:
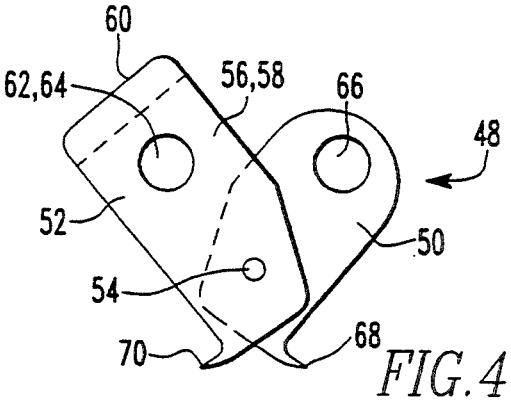
FIG. 4 is a front elevational view of a second embodiment of a locking device of the present invention in a collapsed form prior to its insertion into a cover opening.
Figure 5:
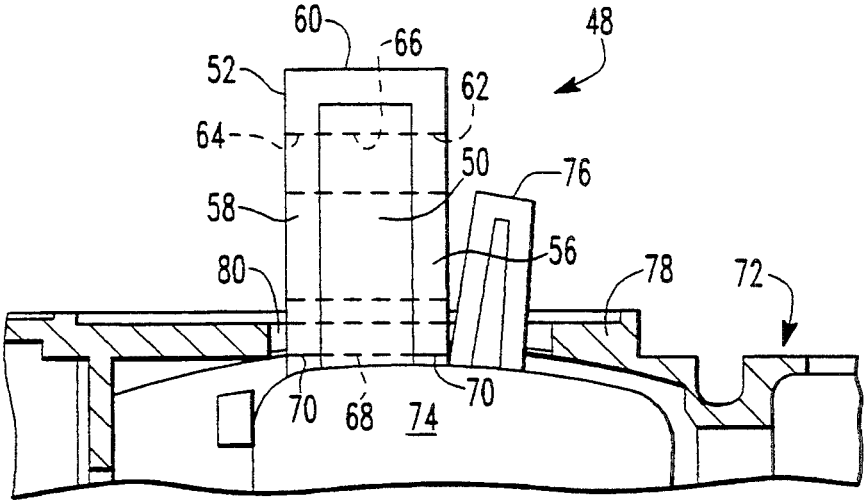
FIG. 5 is a side elevational view of the embodiment of FIG. 4 in an expanded form after its insertion into the cover opening.
Figure 6:
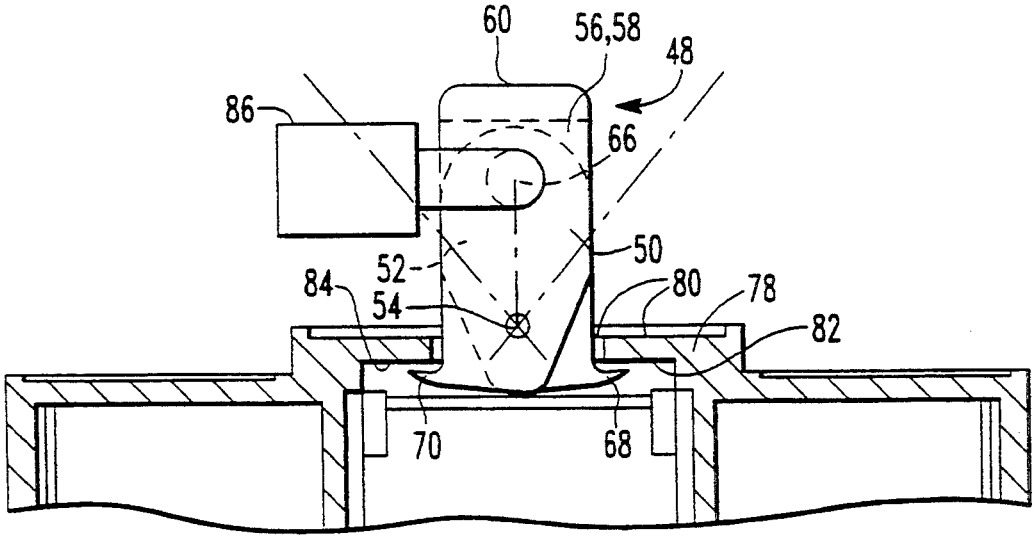
FIG. 6 is a front elevational view of the embodiment of FIG. 4 in an expanded form after its insertion into the cover opening.

A second embodiment for a locking device 48 is shown in FIGS. 4, 5, and 6.

The locking device 48 of FIGS. 4–6 is comprised of pivotal inner member 50 and outer member 52 which are pivotally connected together near their lower ends by pivot pin 54. Pivotal member 52 is in the shape of an inverted "U" to receive member 50 when members 50 and 52 are in their expanded locking position of FIGS. 5 and 6.

Pivot pin 54, as well as pivot pin 32 may be made of a hard, durable plastic or steel. Pivotal member 52 has sidewalls 56 and 58, and top wall 60. Each sidewall 56 and 58 has a transverse aperture 62 and 64, respectively, which are in alignment relative to each other. Inner member 50 has a transverse aperture 66 which is in alignment with transverse apertures 62 and 64 of outer member 52 when locking device 48 is in its expanded and locking position of FIGS. 5 and 6, and which aperture 66 of inner member 50 is in non-alignment with transverse apertures 62 and 64 of outer member 52 when locking device 48 is in its collapsed or non-locking position of FIG. 4.

Both members 50 and 52 have leg means 68 and 70, respectively, which extend along the length of their base, more about which will be discussed hereinbelow.

FIGS. 5 and 6 illustrate the manner in which the locking device 48 of FIG. 4 is installed in a circuit breaker 72 which has an electrical switch 74 with a handle 76 and a cover 78 with an opening 80 through which handle 76 extends. Locking device 48 fills the space in opening 80 of circuit breaker cover 78 which is not occupied by breaker handle 76.

As particularly shown in FIG. 6, the leg means 68 and 70 of pivotal members 50 and 52, respectively, are positioned underneath cover 78 for their engagement with an undersurface 82, 84 of cover 78. While leg means 68 and 70 of members 50 and 52 are being positioned under cover 78, members 50 and 52 are caused to be pivoted with inner member 50 being received between sidewalls 56 and 58 of outer member 52, and the transverse apertures 62, 64, and 66 of pivotal members 50 and 52 are caused to become aligned.

Locking device 48 is secured in cover opening 80 by inserting padlock 86 through aligned apertures 62, 64, and 66.

This embodiment functions similarly to the locking device 10 of FIGS. 1–3, but instead of having a lip or base 36 extending parallel to the handle 20, the locking device 48 of FIGS. 4–6, engages two parallel sides of an undersurface of a cover perpendicular to the length of the breaker handle 76.

Additionally, the locking device of FIGS. 4–6 does not provide a member with an aperture for encasing the breaker handle 76 as does that of FIGS. 1–3.

Figure 7:
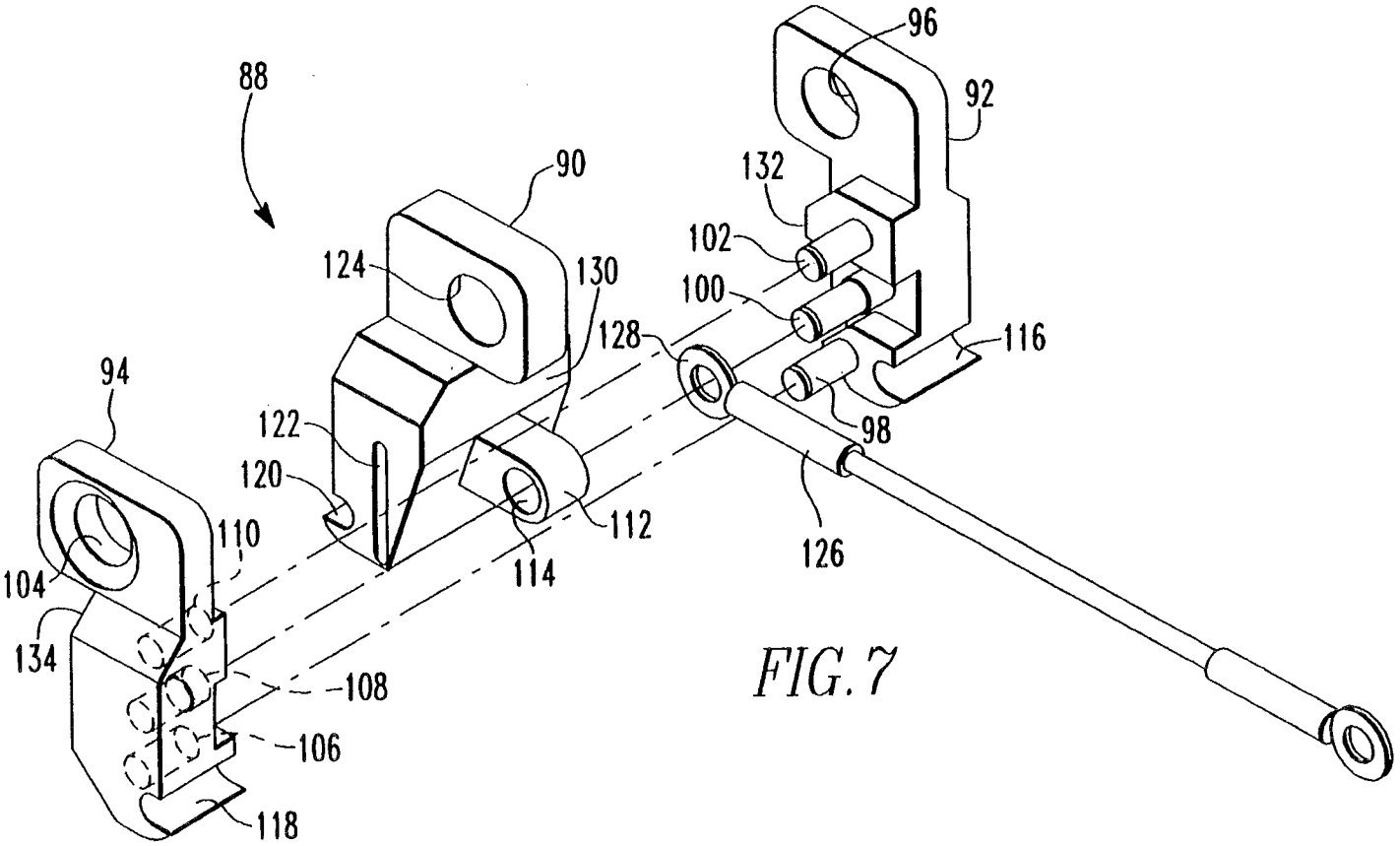
FIG. 7 is an exploded, perspective view of a third embodiment of the locking device of the present invention.
Figure 8:
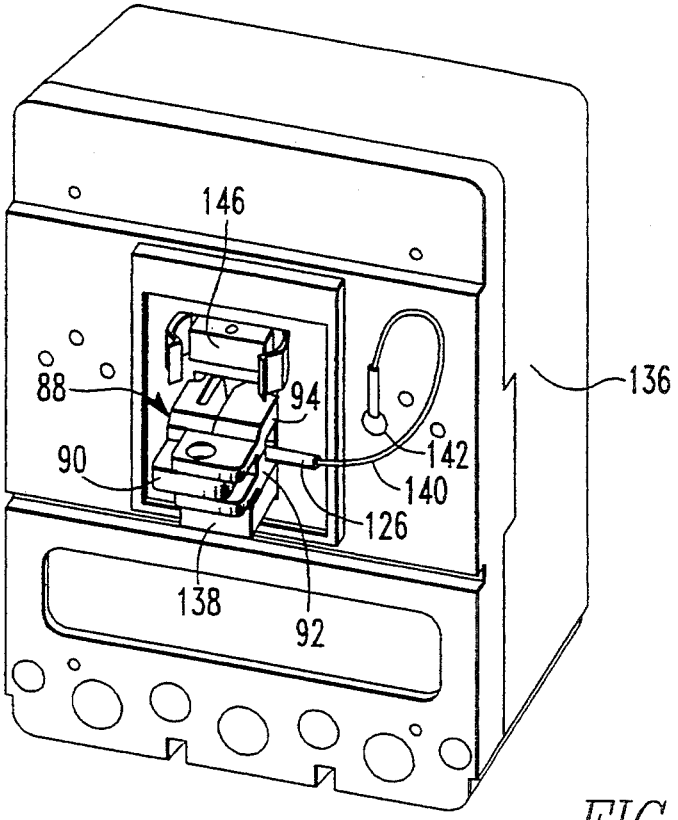
FIG. 8 illustrates the locking device of FIG. 7 installed in an opening of a circuit breaker and having a retainer plate and a retaining cable.
Figure 9:
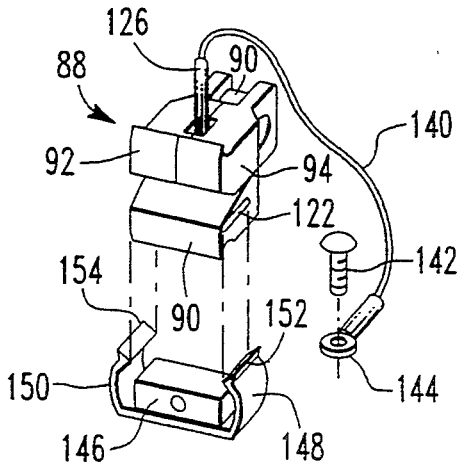
FIG. 9 shows the manner in which the locking device of FIG. 7 is carried by the retainer plate and the manner in which the retaining cable is secured to the front of the circuit breaker.

FIGS. 7, 8, and 9 illustrate a third embodiment of the present invention. The locking device 88 of this embodiment is similar to that of FIGS. 4, 5, and 6 in that it consists of an inner member 90 which is pivotal within an outer means which has two individual members 92 and 94, which are interconnected to form a unitary outer member means. Outer member 92 has a transverse aperture 96 and pins 98, 100, and 102. Outer member 94 has a transverse aperture 104 and openings 106, 108, and 110 for receiving pins 98, 100 and 102, respectively, of outer member 92. For pivotal connection of inner member 90 to the outer members 92 and 94, inner member 90 has a lug 112 with an aperture 114 through which pin 100 of outer member 92 extends.

Outer members 92 and 94 have leg or lip means 116 and 118, respectively, and inner member 90 has leg or lip means 120 extending along the length of their base. Inner member 90 has longitudinal slots along its outer surfaces, one such slot indicated at number 122, more about which will be discussed hereinbelow. Inner member 90 has transverse aperture 124 which lines up with transverse apertures 96 and 104 of outer members 92 and 94 when locking device 88 is in its expanded position, similar to that shown in FIGS. 8 and 9.

Members 90, 92, and 94 of locking device 88 are, preferably, molded plastic, with pins 98, 100, and 102 of outer member 92 and lug 112 of inner member 90 being an integral part thereof.

When members 90, 92, and 94 are assembled together, a cable eyelet piece 126 is attached to the assembled locking device 88 by passing pin 100 through eyelet 128 upon its being passed through aperture 114 of lug 112.

When assembled, inner member 90 pivots within the two outer members 92 and 94 to form a collapsed position and an expanded position. When inner member 90 is pivoted to align its aperture 124 with apertures 96 and 104 of members 92 and 94, respectively, for the expanded position, a slanted surface 130 of inner member 90 abuts against corresponding surfaces 132 and 134 of outer members 92 and 94 to limit pivotal movement of inner member 90.

FIG. 8, in particular, shows locking device 88 in its expanded, operative mode in an opening of a circuit breaker 136. For its installation, the member 90 is pivoted outwardly in a collapsed position such that its aperture 124 is caused to be misaligned with apertures 96 and 104 of members 92 and 94, respectively. The locking device 88 in this collapsed position is inserted into the opening of breaker circuit 136. Inner member 90 is pivoted inwardly, resulting in all members 90, 92, and 94 coming together and leg means 116, 118, and 120 of members 90, 92, and 94 engaging an undersurface of the front cover of circuit breaker 136 along the parallel sides of the opening perpendicular to the length of handle 138 of circuit breaker 136. Even though not shown, a padlock similar to that shown for the first and second embodiments can be secured through aligned apertures 96, 104, and 124.

A retaining cable 140 is secured to the front cover by a drive screw 142 in eyelet 144 (FIG. 9), and a retainer plate 146 is secured on the front cover through any one of a number of means available, such as screws or an adhesive.

Retainer plate 146 has bracket side legs 148 and 150 with lip means 152 and 154, respectively, on its extreme ends. These lip means 152 and 154 on bracket legs 148 and 150 are engageable in the slots, one indicated at 122, alongside the opposite outer surfaces of inner member 90. FIG. 9 in particular shows the manner in which leg means 152 and 154 are received in the slots 122, for retention of locking device 88 of FIGS. 7–9 when it is not being used to resist movement of the handle 138 of circuit breaker 136.

Whereas particular embodiments of the invention have been described above for purposes of illustration, it will be appreciated by those skilled in the art that numerous variations of the details may be made without departing from the invention as described in the appended claims.

Even though the present invention has been described with reference to a circuit breaker, it will be appreciated that it may be used in the environment of any type of machinery or device which has a slidable handle or knob of an electrical switch extending through a cover for setting the machinery or device in its several modes of operation.

In accordance with the patent statutes, we have explained the principles and operation of our invention and have illustrated and described what we consider to be the best embodiments thereof.

What is claimed is:

1. A locking device for restricting movement of an operating handle of an electrical switch, said handle extending through and moveable between opposite ends of a switch opening having parallel sides, said device comprising:

at least two pivotal members connected together for pivotal movement between a collapsed condition and an expanded condition, said two pivotal members being insertable in said switch opening adjacent to said handle with said handle adjacent either of said ends of said switch opening and extending between said handle and the other of said ends of said switch opening when in said collapsed condition and being engageable under said parallel sides of said switch opening and lockable therewith when in said expanded condition for said restricting of said movement of said handle, a first of said two pivotal members comprises at least two interconnected outer members and a second of said two pivotal members comprises an inner member, one of said pivotal members having an integral lug with an aperture pivotally connected to and between another said pivotal member.

2. A device of claim 1, further comprising:

a retaining cable secured to said locking device and to said electrical switch, and retainer means associated with said electrical switch for retaining said locking device when in an inoperative mode.

3. A device of claim 1, wherein said interconnected outer members have integrally formed, cooperating receiving means and receivable means for interconnection of said two outer members.

4. A device of claim 1, wherein said two pivotal members include alignable apertures, and stop means for limiting said pivotal movement of said inner member relative to said outer members and for registering said alignable apertures in alignment, and said device further comprising:

means extendible through said alignable apertures when in said alignment for locking said two pivotal members together when in said expanded condition adjacent to said handle of said electrical switch.

* * * * *